US005915692A

United States Patent [19]

Lu et al.

[11] Patent Number: 5,915,692

[45] Date of Patent: Jun. 29, 1999

[54] PAPER EJECT PASSAGEWAY AUTO-SWITCHING DEVICE

[75] Inventors: Yu-Yang Lu; Cheng-Hsien Lu, both of Taipei, Taiwan

[73] Assignee: Acer Peripherals, Inc., Taiwan

[21] Appl. No.: 08/867,758

[22] Filed: Jun. 3, 1997

[51] Int. Cl.[6] ..... B65H 29/00

[52] U.S. Cl. ..... 271/279; 209/680; 209/682

[58] Field of Search ..... 271/279, 223; 209/634, 680, 682

[56] References Cited

U.S. PATENT DOCUMENTS 4,662,522 5/1987 Kokubun et al. ..... 209/682 X

FOREIGN PATENT DOCUMENTS 3128856 5/1991 Japan ..... 271/279

*Primary Examiner*—David H. Bollinger
*Attorney, Agent, or Firm*—Pillsbury Madison & Sutro LLP

[57] ABSTRACT

This invention discloses a paper eject passageway auto-switching device, which is installed in an information processing machine, suitable for automatically switching between two eject passageways for paper sheets from the processing unit. The paper eject passageway auto-switching device includes: a first paper eject passageway and a second eject passageway. The first paper eject passageway has a first guide vane provided with a guide surface capable of guiding paper sheets from the processing unit to move along the first paper eject passageway, and a first outlet portion through which paper sheets leave the information processing machine. The second paper eject passageway has a branched opening having its width smaller than that of the first guide vane, a second guide vane, and a second outlet portion. The second guide vane has a guide surface capable of guiding paper sheets from the branched opening into the second paper eject passageway. Paper sheets leave the information processing machine through the second outlet portion. The branched opening is located on the guide surface of the first guide vane, paper sheets of widths larger than that of the branched opening are guided to enter the first paper eject passageway and paper sheets of widths smaller than that of the branched opening are guided to enter the second paper eject passageway.

7 Claims, 1 Drawing Sheet

PAPER EJECT PASSAGEWAY AUTO-SWITCHING DEVICE

BACKGROUND OF THE INVENTION

1. Field of the Invention

The present invention relates to a paper eject passageway auto-switching device, in particular to a device capable of automatically performing the selection of paper eject passageway without any switching unit installed therein.

2. Description of Prior Art

Scanners, facsimile machines, and printers are provided with paper feeders which are used to feed sheet papers into and to eject them out of the machines. The following is an explanation of the operation of a paper feeder installed in a sheet-feed type scanner. Documents to be scanned may be of different natures and different sizes. For example, a business card is quite different from an ordinary copy paper in bending resistance and size. FIGS. 1 and 2 are schematic drawings showing the operation of a conventional switching unit installed in a scanner. As shown in FIGS. 1 and 2, when a sheet paper is moving along a paper eject passageway, it can be ejected out of the scanner through an "A" passageway (see FIG. 1) or a "B" passageway (see FIG. 2). The switching between "A" passageway and "B" passageway is performed by a guide plate 30 which can be manually shifted between two locations respectively shown in FIG. 1 and FIG. 2. Namely, when the guide plate 30 is at the location shown in FIG. 1, the sheet paper is guided to pass around a feed roller 32. When the guide plate 30 is shifted upward to the location shown in FIG. 2, the sheet paper passes by the feed roller 32 and is expelled in a direction contrary to that shown in FIG. 1. However, if the guide plate 30 is at the location shown in FIG. 1, a business card is apt to become jammed between the feed roller 32 and the guide plate 30 due to its much greaten resistance to bending. Thus, when a business card is being scanned, the guide plate 30 has to be shifted upward to avoid jamming of the paper.

SUMMARY OF THE INVENTION

The object of the present invention is to provide a paper eject passageway auto-switching device which is capable of automatically performing the selection of paper eject passageway without any switching unit installed therein.

To achieve the above object, according to this invention, a paper eject passageway auto-switching device installed in an information processing machine. The paper eject passageway auto-switching device is suitable for automatically switching between two eject passageways for paper sheets from the processing unit to be ejected from the information processing machine, the paper sheets being of at least two different sizes. The paper eject passageway auto-switching device includes a first paper eject passageway being composed of a first guide vane provided with a guide surface capable of guiding paper sheets from the processing unit to move along the first paper eject passageway, and a first outlet portion through which said paper sheets leave the information processing machine; a second paper eject passageway being composed of a branched opening with a width smaller than that of the first guide vane, a second guide vane provided with a guide surface capable of guiding paper sheets from the branched opening to move along the second paper eject passageway, and a second outlet portion through which paper sheets leave the information processing machine, the branched opening being located on the guide surface of the first guide vane, whereby paper sheets coming from the processing unit of widths larger than that of the branched opening are guided to enter the first paper eject passageway and paper sheets of widths smaller than that of the branched opening are guided to enter the second paper eject passageway.

Furthermore, the guide surface of the first guide vane along the flow way of sheet papers is curved and the guide surface of the second guide vane is flat.

Furthermore, the branched opening of the second paper eject passageway is formed in the first guide vane.

Furthermore, at least one rib is formed in the guide surface of the first guide vane.

Furthermore, the first guide vane and the second guide vane are integrally formed.

Furthermore, the first outlet portion and the second outlet portion are discrete.

Furthermore, the information processing machine is a sheet-feed type scanner.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Figure 1:
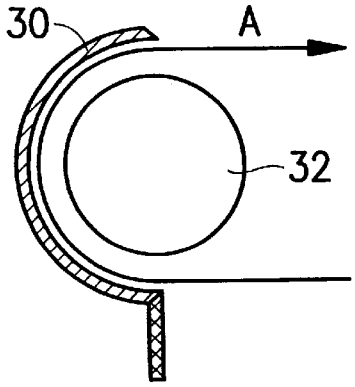
FIG. 1 (PRIOR ART)
FIG. 1 is a schematic drawing showing that a guide plate of a conventional switching unit installed in a scanner is arranged to form an "A" eject passageway.
Figure 2:
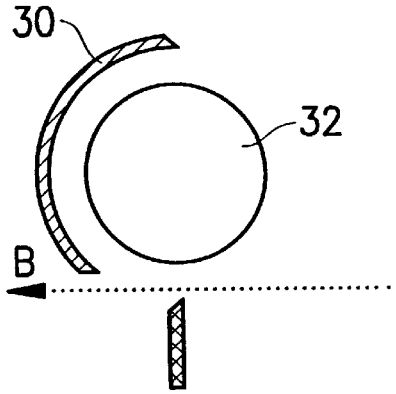
FIG. 2 (PRIOR ART)
FIG. 2 is a schematic drawing showing that the guide plate of FIG. 1 is shifted upward to form a "B" passageway.
Figure 3:
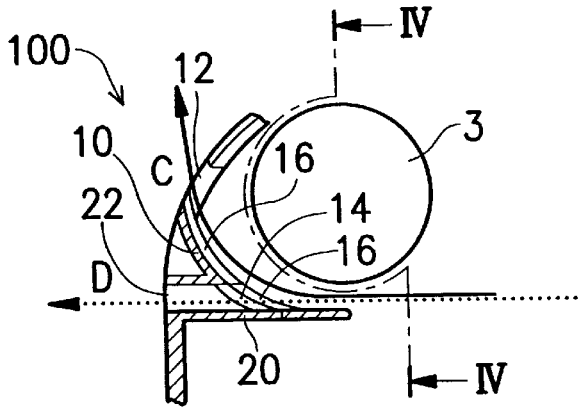
FIG. 3 is a schematic cross-sectional view along line III—III of FIG. 4, showing the structure of a paper eject passageway auto-switching device according to this invention.
Figure 4:
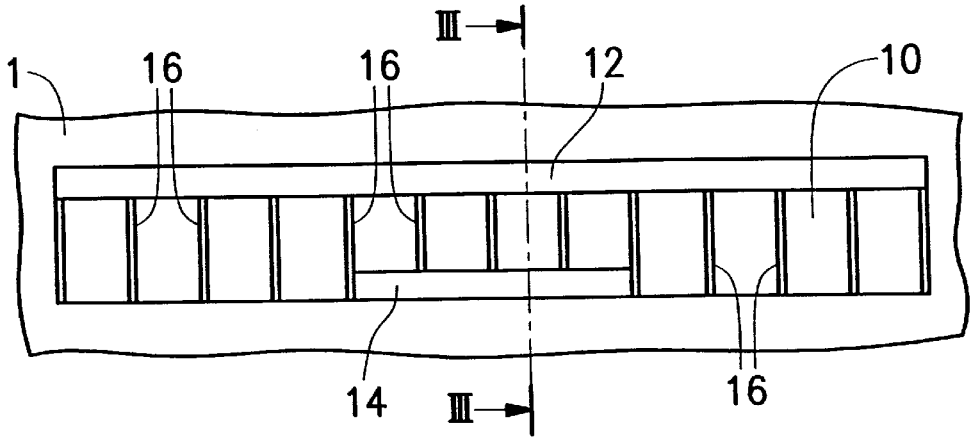
FIG. 4 is a schematic view along line IV—IV of FIG. 3.

FIG. 3 is a schematic cross-sectional view showing the structure of a paper eject passageway auto-switching device 100 according to this invention. The paper eject passageway auto-switching device 100 according to this invention is installed in an information processing machine, such as a scanner, a printer, or a facsimile machine. FIG. 4 is a schematic view along line IV—IV of FIG. 3. As shown in FIG. 3, the paper eject passageway auto-switching device 100 is provided with a first guide vane 10 and a second guide vane 20. The first guide vane 10 is curved. According to the structure, papers from the processing unit of the scanner (not shown) can be guided to move upward along the path shown by arrow C and leave the scanner through an outlet portion 12. As shown in FIG. 4, a plurality of ribs 16 are formed on the first guide vane 10. The ribs 16 are used to reduce the contact area between the first guide vane 10 and the paper moving thereon. By this arrangement, the frictional force incurred between the first guide vane 10 and the paper moving thereon can be reduced. A rectangular branched opening 14 is formed at the lower portion of the first guide vane 10. The width of the branched opening 14 is smaller than that of the first vane 10. The upper surface of the second guide vane 20 is preferably flat. Paper sheets of a width less than that of the branched opening 14 will enter the branched opening 14 and be guided to leave the scanner through an outlet portion 22 along the path shown by arrow D.

According to the structure described above, paper sheets from the processing unit of the scanner can be guided to move upward along the path C and leave the scanner through the outlet portion 12.

A business card of a width less than that of the branched opening 14 can pass through the branched opening 14. Due to the fact that the upper surface of the second guide vane 20 is flat, the business card can be guided to leave the scanner through the outlet portion 22 along the path D without any bending. Thus, the business card can pass the second passageway without jamming.

Therefore, the paper eject passageway auto-switching device according to this invention, when installed in information processing machines, can automatically switch the paper passageway when papers with different sizes are fed into said information processing machines.

Furthermore, due to the fact that a plurality of ribs 16 are formed on the first guide vane 10, frictional forces incurred between the first guide vane 10 and the paper moving thereon can be reduced.

While this invention has been particularly shown and described with reference to the preferred embodiment, it will be understood by those skilled in the art that various changes in form and details may be made without departing from the spirit and the scope of this invention. For example, an auto-switching device with two passageways has been shown in the above-described embodiment. However, auto-switching devices with more than two passageways can also be made by providing the first vane with more than two branched openings of different widths.

What is claimed is:

1. A paper eject passageway auto-switching device installed in an information processing machine, suitable for automatically switching between two eject passageways for paper sheets from the processing unit to be ejected from the information processing machine, the paper sheets being of at least two different sizes, the paper eject passageway auto-switching device comprising:

a first paper eject passageway being composed of a first guide vane provided with a guide surface capable of guiding paper sheets from the processing unit to move along the first paper eject passageway, and a first outlet portion through which said paper sheets leave the information processing machine;

a second paper eject passageway being composed of a branched opening with a width smaller than that of the first guide vane, a second guide vane provided with a guide surface capable of guiding paper sheets from the branched opening to move along the second paper eject passageway, and a second outlet portion through which paper sheets leave the information processing machine, the branched opening being located on the guide surface of the first guide vane, whereby paper sheets coming from the processing unit of widths larger than that of the branched opening are guided to enter the first paper eject passageway and paper sheets of widths smaller than that of the branched opening are guided to enter the second paper eject passageway.

2. A paper eject passageway auto-switching device as claimed in claim 1, wherein the guide surface of the first guide vane along the flow way of sheet papers is curved and the guide surface of the second guide vane is flat.

3. A paper eject passageway auto-switching device as claimed in claim 2, wherein the branched opening of the second paper eject passageway is formed in the first guide vane.

4. A paper eject passageway auto-switching device as claimed in claim 3, wherein at least one rib is formed in the guide surface of the first guide vane.

5. A paper eject passageway auto-switching device as claimed in claim 4, wherein the first guide vane and the second guide vane are integrally formed.

6. A paper eject passageway auto-switching device as claimed in claim 5, wherein the first outlet portion and the second outlet portion are discrete.

7. A paper eject passageway auto-switching device as claimed in claim 6, wherein the information processing machine is a sheet-feed type scanner.

* * * * *